US008249739B2

(12) United States Patent
Nishitani et al.

(10) Patent No.: US 8,249,739 B2
(45) Date of Patent: Aug. 21, 2012

(54) YARN FEEDING DEVICE AND YARN FEEDING METHOD FOR KNITTING MACHINE

(75) Inventors: Hirokazu Nishitani, Wakayama (JP); Yoshiyuki Komura, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 13/376,958

(22) PCT Filed: May 18, 2010

(86) PCT No.: PCT/JP2010/058341

§ 371 (c)(1),
(2), (4) Date: Dec. 8, 2011

(87) PCT Pub. No.: WO2010/143498

PCT Pub. Date: Dec. 16, 2010

(65) Prior Publication Data

US 2012/0079856 A1 Apr. 5, 2012

(30) Foreign Application Priority Data

Jun. 9, 2009 (JP) ..... 2009-138365

(51) Int. Cl.
*G06F 19/00* (2006.01)

(52) U.S. Cl. ..... 700/141; 66/125 R

(58) Field of Classification Search ..... 700/141, 700/132; 66/125 R, 126 R, 127, 132 R, 138, 66/71, 64, 77

See application file for complete search history.

(56) References Cited

U.S. PATENT DOCUMENTS

| | | | | |
|---|---|---|---|---|
| 6,010,052 | A | 1/2000 | Leins et al. | |
| 6,079,656 | A * | 6/2000 | Schmodde et al. | 66/132 R |
| 6,170,301 | B1 * | 1/2001 | Stoll et al. | 66/126 R |
| 7,055,349 | B2 * | 6/2006 | Morita et al. | 66/146 |
| 7,218,988 | B2 * | 5/2007 | Morita et al. | 700/141 |
| 7,289,869 | B2 * | 10/2007 | Morita | 700/141 |
| 7,493,188 | B2 * | 2/2009 | Minakata et al. | 700/141 |
| 2007/0000287 | A1 | 1/2007 | Morita et al. | |
| 2008/0148782 | A1 | 6/2008 | Minakata et al. | |

FOREIGN PATENT DOCUMENTS

| | | |
|---|---|---|
| DE | 40 32 402 A1 | 4/1992 |
| JP | 4016030 B2 | 9/2007 |

* cited by examiner

*Primary Examiner* — Danny Worrell
(74) *Attorney, Agent, or Firm* — Rothwell, Figg, Ernst & Manbeck, P.C.

(57) ABSTRACT

A yarn feeding device for a knitting machine comprises a motor for driving a roller from which a yarn is fed out, and a rotatable arm which intermediately stores the yarn fed out from the roller, and the yarn is fed from the arm to a knitting machine body. A torque generator is provided to apply a variable torque to the arm. A yarn speed is obtained from a loop length of a stitch for each knitting needle and a knitting speed calculated on the basis of knitting data used in the knitting machine body. The yarn speed is converted into a torque to be applied to a buffer using a conversion table at each knitting section in a knitting course so as to correct a yarn tension fluctuation caused by the yarn speed, and the torque generator is controlled in accordance with the torque thus obtained. The yarn tension fluctuation is reduced so that high-speed knitting and knitting using a weak yarn can be facilitated.

5 Claims, 6 Drawing Sheets

Prior Art

YARN FEEDING DEVICE AND YARN FEEDING METHOD FOR KNITTING MACHINE

CROSS REFERENCE TO RELATED APPLICATION

This application is a 35 U.S.C. 371 National Phase Entry Application from PCT/JP2010/058341, filed May 18, 2010, which claims the benefit of Japanese Patent Application No. 2009-138365 filed on Jun. 9, 2009, the disclosure of which is incorporated herein in its entirety by reference.

TECHNICAL FIELD

The present invention relates to improvement of a yarn feeding device and a yarn feeding method for supplying a yarn to a knitting machine such as a flat-knitting machine or a circular knitting machine.

BACKGROUND ART

The inventors have proposed a yarn feeding device for feeding a yarn of required length using a servomotor in accordance with a knitting section to be knitted, and supplying the yarn to a carrier of a knitting machine by means of an arm functioning as a buffer (Patent Document 1: JP4016030B, Patent Document 2: JP 2006-169675A). The amount of yarn required per unit of time is referred to as "yarn speed" in this specification. The yarn speed is decided by a yarn length used for forming stitches and changes in the yarn length between the buffer arm and the needle bed that are caused by a motion of the carrier. The buffer arm is often simply called "arm."

According to Patent Documents 1 and 2, the arm is biased by a spring so as to provide a substantially constant tension to the yarn. Here, Patent Document 1 discloses that the loop length of the stitch for each knitting needle is calculated based on the knitting data and that the knitting yarn just required for knitting is fed out actively in synchronization with a motion of the carrier. When knitting at high speed, however, it has been found that simply controlling the amount of yarn to be fed might cause a high tension peak to the yarn and consequently cut the yarn. Patent Document 2 discloses that a yarn feeding speed is increased prior to a sharp increase of the yarn speed to store excess yarn in the arm in order to prepare for a section where the yarn speed increases. However, when a sufficient amount of the excess yarn is reeled out beforehand, the yarn tension lowers, and consequently the yarn becomes loose. For these reasons, it is difficult to reduce the yarn tension fluctuations when knitting at speeds higher than the speeds assumed in Patent Documents 1 and 2.

The present inventors, therefore, examined to actively control the arm torque by means of a torque generator such as a torque motor, instead of passively controlling the arm by means of the spring. With regard to controlling the torque of the arm of a flat-knitting machine, a circular knitting machine or other knitting machines, Patent Document 3: JP2951068B discloses performing feedback control on the drive torque of the arm by means of a tension sensor provided on the downstream side of the buffer arm. However, according to the experiments by the present inventors, the feedback control has been found not enough to prevent the high tension peak at high speed knitting. The yarn tension peak caused small stitches where the loop lengths thereof were reduced, and sometimes the yarns were cut because the tension of the yarns exceeded their durability. Even at the conventional knitting speeds, decorative yarns or the like easily broken yarns may be cut with the fluctuations in the yarn tension.

Patent Document 1: JP4016030B

Patent Document 2: JP2006-169675A

Patent Document 3: JP2951068B

DISCLOSURE OF THE INVENTION

The object of the present invention is to reduce the fluctuations of yarn tension and to help knitting at high speeds or with weak yarns.

A yarn feeding device for a knitting machine according to the present invention is a device that has a motor for driving a roller from which a yarn is fed out on the basis of knitting data inputted into the knitting machine, and a rotatable buffer for intermediately storing the yarn fed out from the roller and supplying the yarn to the knitting machine, the yarn feeding device further comprising:

a torque generator for applying a variable torque to the buffer;

a yarn speed calculator for obtaining yarn speeds at plural sections in a knitting course from a loop length of a stitch for each knitting needle and a knitting speed calculated base on the knitting data;

conversion means for converting, at the plural sections in the knitting course, the yarn speeds into a plurality of torques to be applied to the buffer so as to correct yarn tension fluctuation caused by the changes in the yarn speeds; and a torque controller controlling the torque generator at the plural sections in the knitting course so that the torque to be applied to the buffer becomes the torque obtained by the conversion unit.

A method according to the present invention is a method for using a motor to drive a roller from which a yarn is fed out on the basis of knitting data inputted into a knitting machine, storing the yarn fed out from the roller in a rotatable buffer, and supplying the yarn from the buffer to the knitting machine body, the yarn feeding method being characterized in having the steps of:

applying variable torques to the buffer by means of a torque generator;

obtaining yarn speeds at plural sections in a knitting course, from a loop length of a stitch for each knitting needle and a knitting speed calculated based on the knitting data;

converting, at the plural sections in the knitting course, the yarn speeds into torques to be applied to the buffer so as to correct yarn tension fluctuation caused by the changes in the yarn speeds; and controlling the torque generator at the sections in the knitting course so that the torque to be applied to the buffer becomes the torque obtained by said converting.

According to the present invention, yarn tension fluctuations caused by the changes in yarn speeds are reduced with controlling the torque to the buffer at plural sections in the knitting course. The torque is controlled in accordance with the yarn speed obtained based on the knitting data, namely, the speed of the yarn supplied from the buffer on the basis of the knitting data. Thus, the control is not a feed back control based on the tensions, but the torque is controlled by a feed-forward control, which does not cause a delay because of a sensor and the torque generator. Thus, even when knitting a knitted fabric at a high yarn speed of, for example, 7 m/sec or above, the yarn tension can be made almost constant. As a result, even when performing high-speed knitting or knitting using a weak yarn, the yarn may be prevented from cutting. Preventing the yarn tension fluctuations can also prevent the sizes of stitches from fluctuating. Note that, in this specification, the descriptions about the yarn feeding device apply to the yarn feeding method, and the descriptions about the yarn feeding method apply to the yarn feeding device. The knitting data are data stored in the knitting machine for performing knitting. The knitting speed may be added annually or by default when supplying data containing the knitting speed from the start or after supplying data that do not containing the knitting speed.

It is preferred that the yarn feeding device for a knitting machine be provided with a sensor for detecting a rotation angle of the buffer, and that the torque controller corrects the torque obtained by the conversion unit, such that the rotation angle falls within a predetermined range. When the yarn is fed out at yarn speeds by a servomotor for feeding out the yarn, the rotation angle should be constant. Correcting the torques to make the rotation angles constant can also correct errors in the amount of yarn to be fed.

It is more preferred that the conversion unit has a table for obtaining the torque as a function of the yarn speed, and correction unit for correcting the torque obtained from the table such that the torque becomes smaller at a section where the yarn speed increases than other sections, for example, where the speed increases sharply. In this manner, the total number of knitting needles operating the yarn reaches a maximum value, and the tension peak that is caused when the course knitting shifts from a knitting-start section to a knitting-middle section can be eliminated or reduced. Therefore, the yarn can be prevented from cutting or becoming tight even when knitting at high speeds.

Providing a plurality of the tables depending on a target yarn tension can allow knitting with an appropriate tension in accordance with a knitting operation using a yarn that easily or hardly cuts or a knitting operation using a single yarn or two-fold yarn.

BEST MODE FOR CARRYING OUT THE INVENTION

Figure 1:
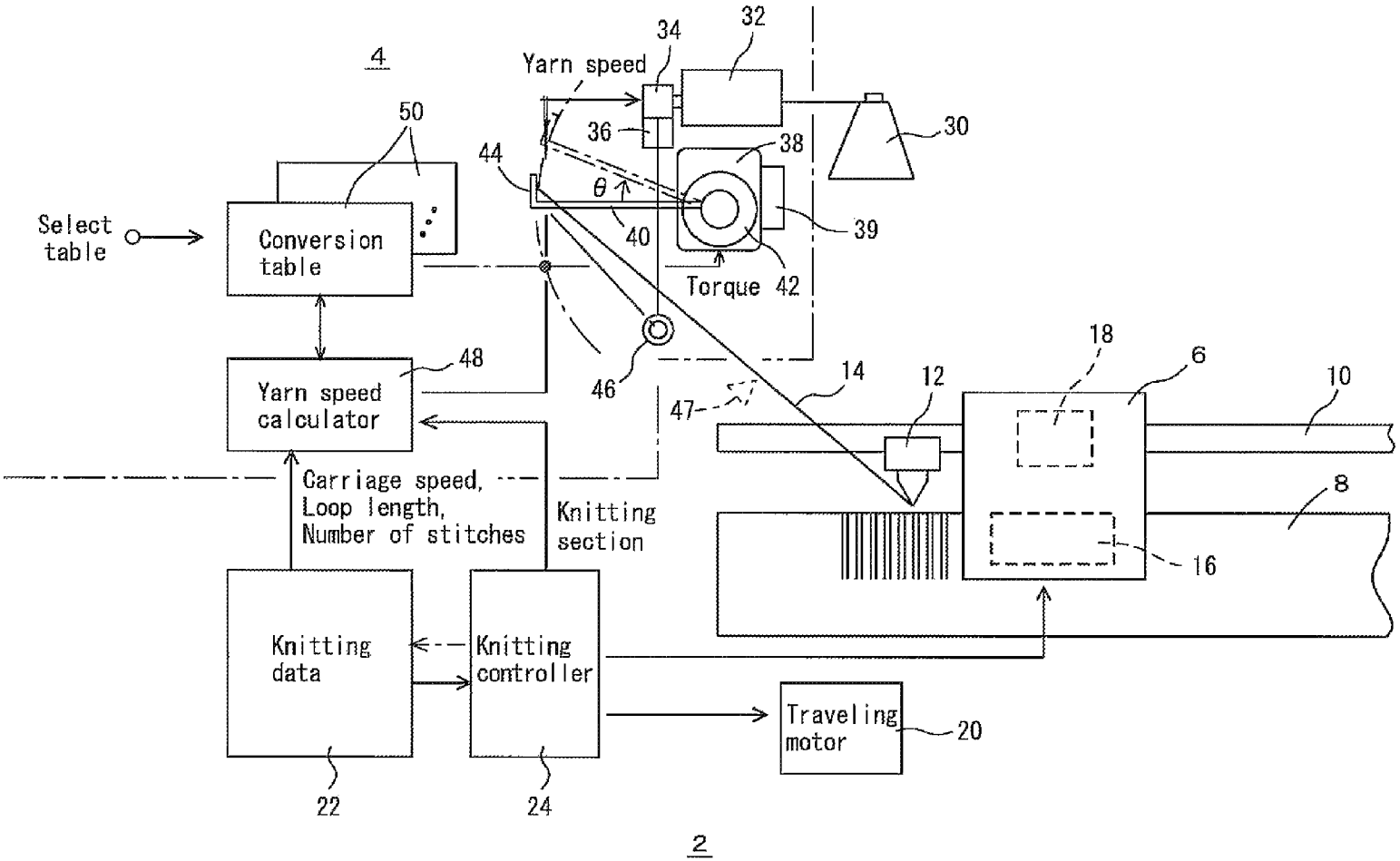
FIG. 1 is a diagram showing a yarn feeding device and a flat-knitting machine according to an embodiment.

The best mode for carrying out the present invention is described hereinafter. The scope of the present invention should be interpreted on the basis of the appended claims and the possibility of modifications made by well-known techniques.

Embodiments

An embodiment of supplying yarns from the left-hand side to a flat-knitting machine is illustrated in FIGS. 1 to 9, but the yarns may be supplied from above or the right-hand side. In these diagrams, reference numeral 2 represents a flat-knitting machine body, which may be a circular knitting machine body, and 4 a yarn feeding device. In the embodiment, the yarn feeding device 4 is integrated with the flat-knitting machine, but the yarn feeding device 4 may be independent of the flat-knitting machine body 2. Hereinafter, the flat-knitting machine body 2 is simply referred to as "flat-knitting machine 2." The flat-knitting machine 2 has a carriage 6 and one or two pairs of needle beds 8. Carriers 12, which are moved along carrier rails 10, are operated by, for example, the carriage 6, to supply yarns 14 to knitting needles of the needle beds 8.

The carriage 6 has a needle selecting device 16 to select which knitting needles of the needle beds 8 to drive, and performs knitting with cams 18 by driving the selected knitting needles. The knitting operation includes formations of stitches and transfers of the stitches, the formations of stitches being performed using the yarns 14. The carriage 6 is reciprocated along the needle beds 8 by a traveling motor 20. Reference numeral 22 represents knitting data, which are supplied from a LAN, a CD-ROM or a USB memory, not shown, to the flat-knitting machine 2, or obtained by adding, manually or by default, a moving speed of the carriage (knitting speed) or the like to pattern data supplied from a USB memory or the like to the flat-knitting machine 2 and control data of the carriage or the like. A knitting controller 24 extracts control data of the traveling motor 20, the control data of the carriage 6, and operation data of the carrier 12, from the knitting data, to control the flat-knitting machine 2.

The yarn feeding device 4 extracts the yarns 14 from cones 30 disposed in an upper part or the like of the flat-knitting machine 2, drives driving rollers 34 using servomotors 32, and reels the yarns 14 in and out from gaps between the driving rollers 34 and driven rollers 36. Note that other motors may be added to, for example, an upstream side of the servomotors 32 to reel the yarns 14 in. Reference numeral 38 represents torque generators such as torque motors, which, for example, generate desired torques and are controlled by a control unit 39. Reference numeral 40 represents buffer arms, which is rotated by the torque from the torque generators 38. A rotation angle of the buffer arms are represented as θ, as shown in FIG. 1. The rotation angles θ, which become positive in a direction of storing the yarn and negative in a direction of releasing the yarn, are monitored by θ sensors 42 provided on output shafts or the like of the torque generators 38.

Reference numeral 44 represents yarn guides at tip ends of the buffer arms 40, and 46 yarn guides on upstream sides of the buffer arms 40 for guiding the yarns between the driving rollers 34 and the yarn guides 44. The carriers 12 described above are disposed on the downstream side of the yarn guides 44 and supply the yarns to the knitting needles of the needle beds 8. Note that a tension sensor 47 for creating conversion tables 50 may be provided between a buffer arm 40 and a carrier 12, but the tension sensor 47 is not provided in this embodiment. In addition, the components from the servomotor 32 to the buffer arm 40, and the yarn guides 44, 46 and the like are provided, for example, in six to twelve sets for each knitting machine 2.

Reference numeral 48 represents a yarn speed calculator for analyzing the knitting data 22 and calculating and storing the length of the yarn to be supplied to the flat-knitting machine 2 per unit time or the yarn speed for the length corresponding to a knitting unit such as a garment. The yarn speed is determined by, for example, the speed of the carriage 6 specified by the knitting data, a loop length for each stitch formed by the knitting needles and the number of stitches formed per unit time. In other words, when integrating the loop length for each stitch, the length of the yarn to be consumed within a knitted fabric is determined, and changes in the position of the carrier 12 are determined from the speed of the carriage 6. When the positions of the carrier 12 are changed, the lengths of the yarn between the buffer arm 40 and the carrier 12 are changed. In summary, the yarn speed is a total of a yarn consumption speed in the flat-knitting machine 2 and a yarn entry/exit speed associated with the positional change of the carrier 12. The yarn speed is obtained from the knitting data 22 by the yarn feeding device 4, but the yarn speed and the torque to be applied to the buffer arm may be obtained by the knitting controller 24 and supplied to the yarn feeding device 4. The servomotor 32 supplies the yarn corresponding to the yarn speed from the roller 34 to the buffer arm 40.

The conversion table 50 converts the yarn speed to the torque to be generated by the torque generator 38, and a target torque value is stored in the yarn speed calculator 48 in units of one garment, for example. The knitting controller 24 obtains a currently knitted section, from an encoder value of the traveling motor 20 or a signal from a sensor such as a needle selection gauge, not shown, and inputs the signal into the yarn speed calculator 48. The yarn speed calculator 48 supplies, to the control unit 39, a torque for a knitting section to be knitted in the future which is equal to the delay in response of the torque generator 38 and so on, rather than a torque for the currently knitted section. However, the yarn speed calculator 48 may read out the torque from the table 50 in accordance with the data on the knitted section obtained from the knitting controller 24. The yarn speed calculator 48 may also obtain the yarn speed from the knitting data in accordance with the data on the knitted section obtained from the knitting controller 24, and convert the torque using the table 50. Note that a plurality of the conversion tables 50 are provided in accordance with, for example, target yarn tension values, and which one of the conversion tables is used is selected according to a target yarn tension value. The selection of conversion tables is inputted from a user interface of the knitting machine body 2 or described in the knitting data 22. Furthermore, the yarn speed calculator 48 and the conversion tables 50 are not provided for each of the servomotors 32 and torque generators 38, and control the servomotors 32 and torque generators 38 by the common yarn speed calculator 48 and the common conversion tables 50.

Figure 2:
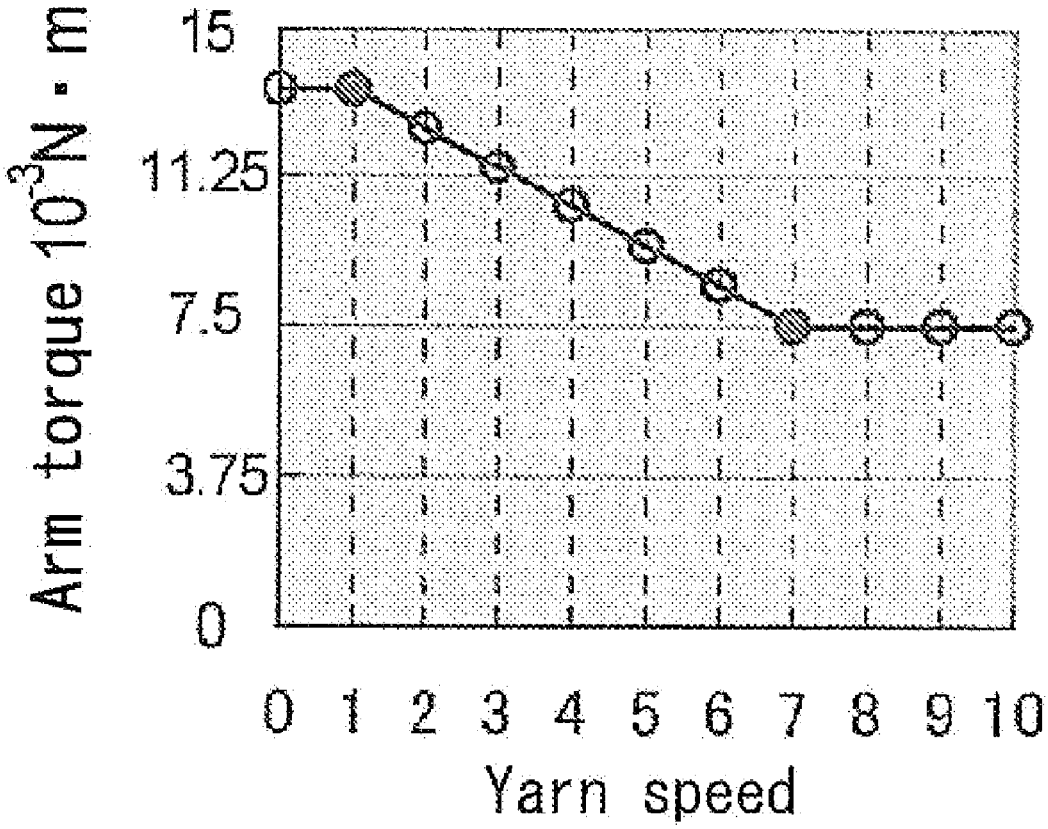
FIG. 2 is a diagram showing an example of a conversion table according to the embodiment.

FIG. 2 shows an example of the conversion table 50, which is designed for the knitting at 0.16 N (16 gf) as the tension of the yarn 14. In the conversion table shown in FIG. 2, the torque are constant for a yarn speed of 1 m/sec or lower and $13.5\times10^{-3}$ N·m, when the yarn speed is 7 m/sec or higher, the torque is constant at $7.5\times10^{-3}$ N·m. When the yarn speed is within a range of 1 to 7 m/sec, the torque applied to the arm 40 is reduced linearly with the yarn speed. Here, the radius of the arm 40 is 7.5 cm. The torque is used for the control of the torque generator 38, and the force applied to the yarn guide 44 at the tip end of the arm 40 is important for the yarn. Therefore, the force is expressed in units of gf (1 gf=approximately 0.01 N) with dividing the torque to be applied to the arm 40 by the radius 7.5 cm. Because the target of yarn tension varies depending on the strength of the yarn or whether knitting is performed with a single yarn or two yarns, a plurality of the conversion tables 50 are provided. In order to generate the conversion tables 50, the torque to the arm 40 is controlled so that the tension of the yarn 14 becomes the target value with monitor by the tension sensor 47 with respect to various yarn speeds. The feedback control on the arm 40 by means of the tension sensor 47 at the knitting-start section and a knitting-end section may not keep the tension constant due to the delay in the torque generator 38. Thus, the torques required for the constant yarn tension are measured at the knitting-middle section where the yarn speed is constant.

High-speed knitting is now described. The conventional fastest flat-knitting machines knit at a knitting speed (the speed of the carriage) of approximately 1.3 m/sec, the knitting speed corresponds to a width knitted each second. When this knitting speed is converted into a yarn speed, it is approximately 6.2 msec. High-speed knitting means knitting where the yarn speed is higher than the abovementioned speed, such as knitting at a yarn speed of 7 m/sec (1.47 m/s in knitting speed) or higher, or more specifically knitting at a yarn speed of 7.7 m/sec (1.6 m/s in knitting speed) or higher. The problems of the high-speed knitting are:

(1) Increase in a tension applied to the yarn;

(2) Formation of a tension peak at a section where the yarn speed increases sharply, and, as a result, the yarn cuts frequently; and (3) Significant fluctuations in yarn tension, which change the sizes of stitches.

Note that the increase in yarn tension reduces the loop length of stitches and therefore causes tight stitches, but a decrease in yarn tension increase the loop length and causes loose stitches. The yarn tension needs to be prevented from fluctuating, in order to achieve the uniform loop length.

Controlling the arm torques and preventing the tension fluctuations are not limited to this high-speed knitting. For example, when a weak yarn is used for knitting, even a small tension fluctuation can cut the yarn.

Figure 3:
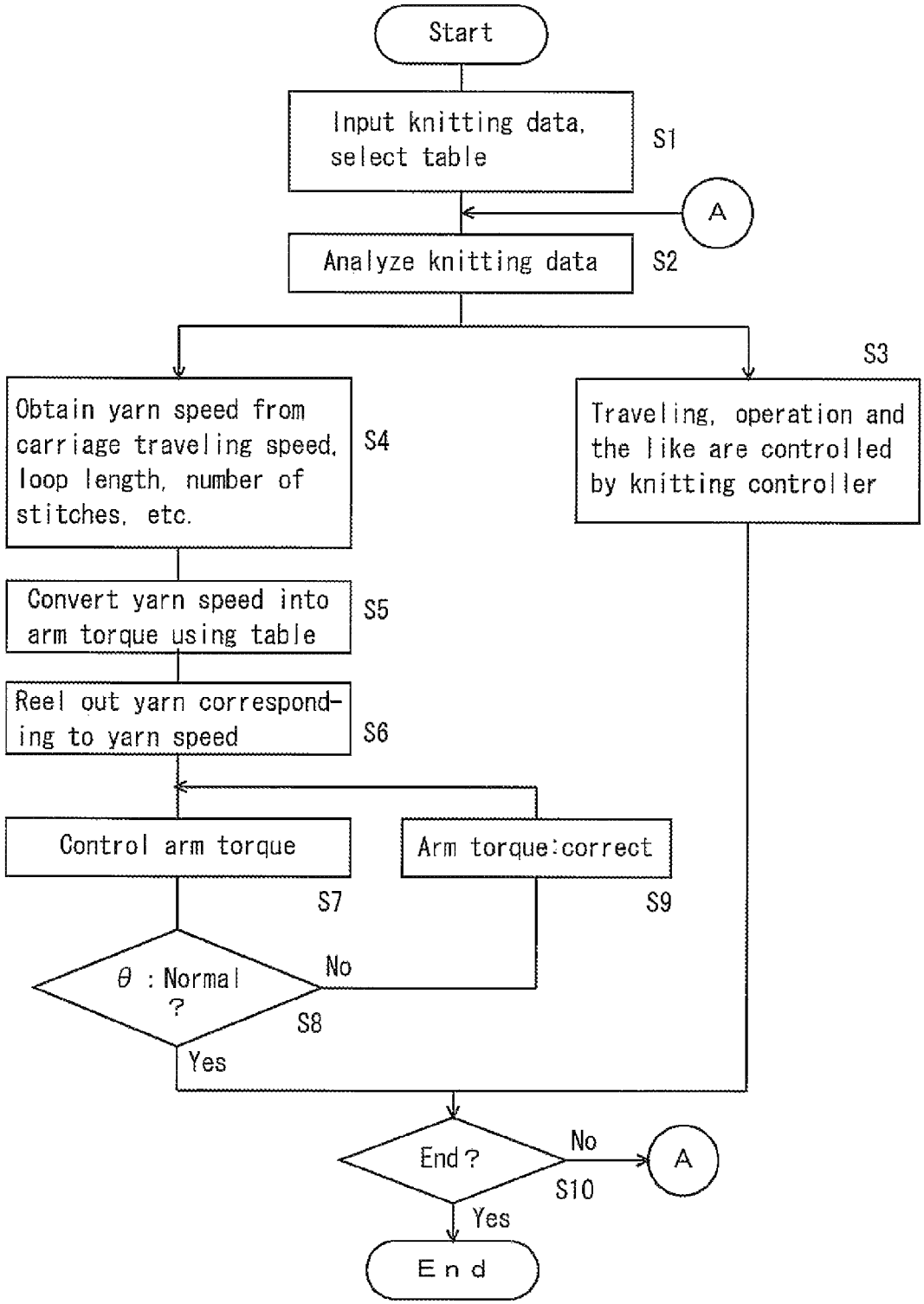
FIG. 3 is a flowchart showing a yarn feeding method according to the embodiment.

FIG. 3 shows an algorithm according to the embodiment. In step 1, the knitting data are input from a storage medium such as a CD-ROM or a USB memory or from a LAN. A conversion table is selected from the knitting data 22 or the user interface of the flat-knitting machine 2. The knitting data are analyzed by the knitting controller 24 (step 2), and then the knitting controller 24 controls the traveling motor 20 and the carriage 6 to perform knitting (step 3).

In the yarn feeding device 4, a traveling speed of the carriage, a loop length of each stitch, and the number of stitches to be formed are obtained based on the knitting data, and subsequently a required length of yarn, or the yarn speed, is obtained within a predetermined time period such as 1 msec to 10 msec (step 4). In step 5, the yarn speed is converted into the arm torque on the basis of the conversion table 50. The yarn corresponding to the yarn speed is fed out by the servomotor 32 in step 6, and the torque generator 38 is controlled by the control unit 39 in accordance with the obtained arm torque (step 7). The θ sensor 42 detects the rotation angle θ of the buffer arm 40 at all times. When the rotation angle θ exceeds an allowable range of ±5°, for example, the arm torque is corrected by the control unit 39 (step 8, step 9). Because the yarn corresponding to the yarn speed is always reeled out by the servomotor 32, the rotation angle θ is kept at a constant level as long as there are no yarn tension fluctuations or errors in the amount of yarn consumption.

Control by the knitting controller 24, feeding of the yarn corresponding to the yarn speed by means of the servomotor 32, and control on the buffer arm 40 by the torque generator 38 are performed in parallel, and when the process of obtaining the yarn speed is ended, the whole process returns from a connector A to step 2, and the subsequent step on the next yarn speed is executed.

Figure 4:
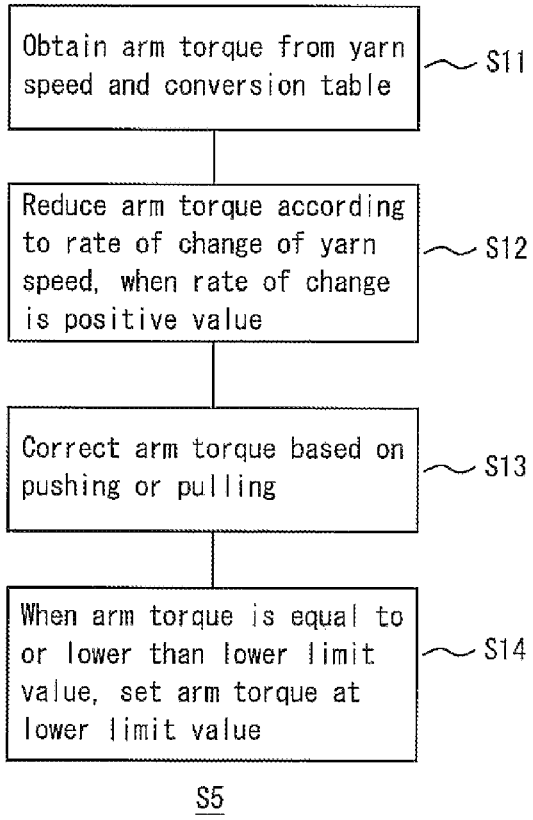
FIG. 4 is a diagram showing a conversion algorithm for converting a yarn speed into a torque of an arm on the basis of the conversion table according to the embodiment.

FIG. 4 shows a conversion algorithm for converting the yarn speed into the torque, which is performed in step 5 shown in FIG. 3. In step 11, the conversion table 50 shown in FIG. 2 is used for obtaining the arm torque. When the rate of change of the yarn speed is a positive value, the arm torque obtained in step 11 is reduced in accordance with the rate of change (step 12). In this step, the arm torque may be reduced proportionally to the rate of change, or an appropriate threshold value may be provided and the arm torque may be reduced when the rate of change is greater than the threshold value. Furthermore, the arm torque may be reduced in proportion to the square of the rate of change. Whether the direction of a motion of the carrier 12 is in a pulling direction in which the yarn 14 is pulled out of the buffer arm 40 or in a thrusting or pushing direction in which the carrier 12 moves toward the arm 40, is already reflected into the yarn speed. Therefore, the effects of the pushing direction or the pulling direction are already processed in step 11, but, if necessary, the arm torque is further corrected in step 13, depending on whether the direction of the motion of the carrier 12 is in the pushing direction or the pulling direction. When the arm torque is excessively reduced, the yarn 14 becomes loose. Thus, when a lower limit value is provided and it is determined in steps 11 to 13 that the arm torque is less than the lower limit value, the arm torque is set at the lower limit value (step 14).

Figure 5:
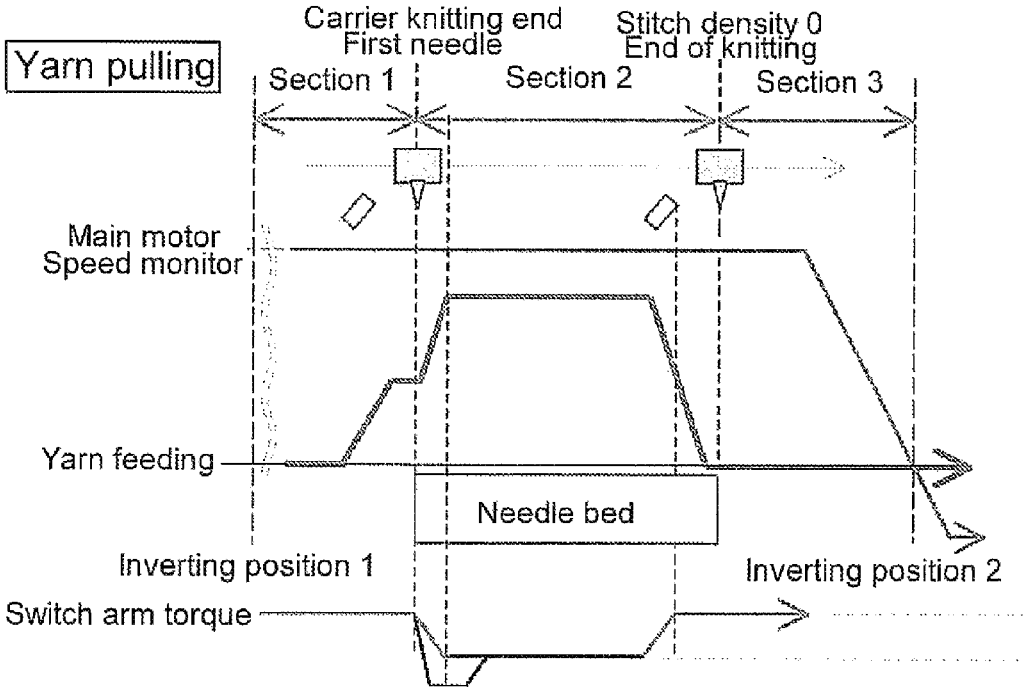
FIG. 5 is a diagram showing a position within a section and the torque of the arm when yarn pulling knitting is performed.

FIG. 5 shows an arm torque control pattern obtained in yarn pulling knitting or pulling knitting. Sections 1, 2 and 3 are knitted with different carriers, and the section 2 is explained herein. In the yarn pulling knitting shown in FIG. 5, the carrier knits the section from left to right. Because the carrier starts moving prior to the formation of stitches, the yarn speed is generated, and the yarn is fed out at a speed equal to the yarn speed. Because the carrier is already traveling at a constant speed when the yarn is supplied to the first knitting needle, the yarn speed also becomes constant. After the yarn is supplied from the carrier to the first knitting needle, the number of knitting needles concurrently operating the yarn 14 increases. The number of knitting needles here is the number of knitting needles operated for forming stitches simultaneously by the cam 18 of the carriage 6. The yarn speed therefore further increases from the yarn speed obtained at the position of the first knitting needle and then reaches a constant value. When the yarn speed becomes constant, the knitting mode is shifted from the knitting-start section to the knitting-middle section. When the knitting mode shifts to the knitting-end section at the end of the section 2, the number of knitting needles decreases gradually, whereby the yarn speed gradually lowers and becomes 0 upon cancellation of the operation of the carrier.

The arm torque is kept at a relatively high value in order to prevent the yarn from becoming loose when the knitting is halted, and the yarn speed is low before the first knitting needle starts operating the yarn. Therefore, the arm torque is reduced as the yarn speed increases, during a period from when the torque on the left of FIG. 2 is in a constant region till the yarn speed reaches the constant value. Abnormal yarn tension peaks might occur during the process where the yarn speed increases, especially from the last half of the knitting-start section to the initial stage of the knitting-middle section. In order to prevent the abnormal yarn tension peaks, the arm torque is reduced in accordance with the rate of change of the yarn speed, and further reduced to, for example, the lower limit value from the last stage of the knitting-start section to the initial stage of the knitting-middle section. Subsequently, the arm torque is returned to the value corresponding to the constant yarn speed obtained during the knitting-middle section. When the yarn speed decreases at the knitting-end section, the arm torque is gradually increased and kept constant upon release of the carrier from the carriage, and the knitting is halted.

The torque generator 38 consumes approximately 100 mA current, for example. Therefore, the yarn is preferably prevented from becoming loose, by, for example, locking the arm 40 or reeling a predetermined length of yarn in by means of the servomotor 32, in order to halt the operation of the torque generator 38 while the carrier is not operated. Moreover, in the present embodiment, the arm torque is corrected in accordance with the rate of change of the yarn speed, but this correction may be omitted and the arm torque may be controlled only based on the value of the yarn speed.

Figure 6:
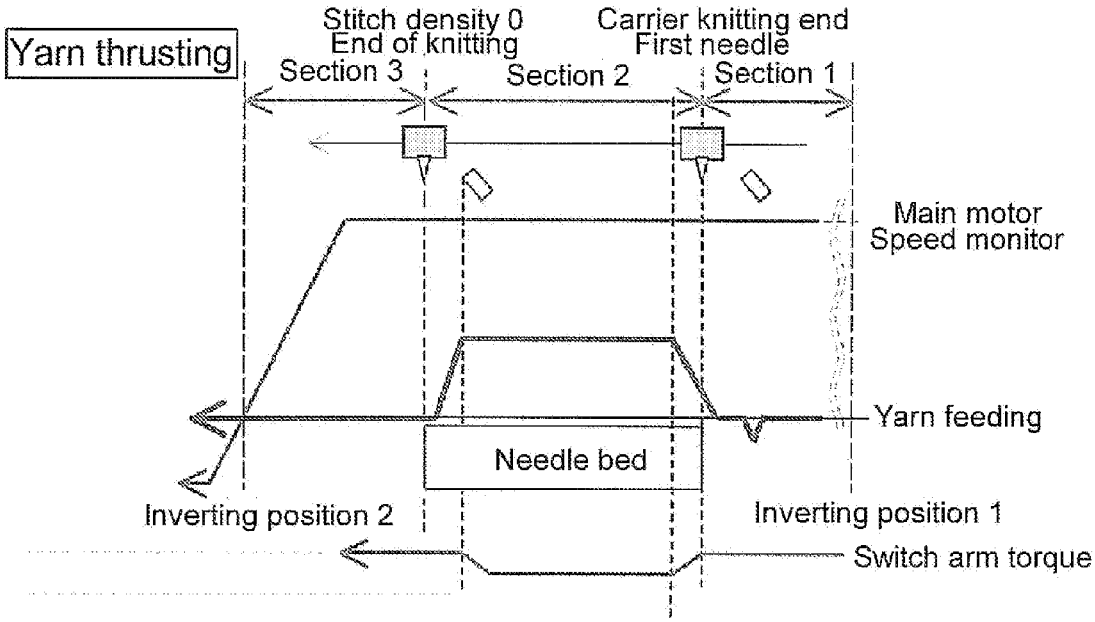
FIG. 6 is a diagram showing a position within a section and the torque of the arm when yarn thrusting knitting is performed.

FIG. 6 shows a pattern obtained when performing yarn pushing knitting, wherein the carriage travels from right to left. In the yarn pushing knitting, yarn slack is generated when the operation of the carrier is started. The servomotor 32 is reversed to absorb the yarn slack. Because the maximum value of the yarn speed is small in the yarn pushing knitting, the arm torque can be controlled easily. When the knitting is started, the arm torque is reduced linearly in relation to the yarn speed in the knitting-start section. The arm torque is made constant in the knitting-middle section, and at the knitting-end section the arm torque is increased before the number of knitting needle used and the yarn speed decrease. In this manner, the yarn is prevented from becoming loose.

Figure 7:
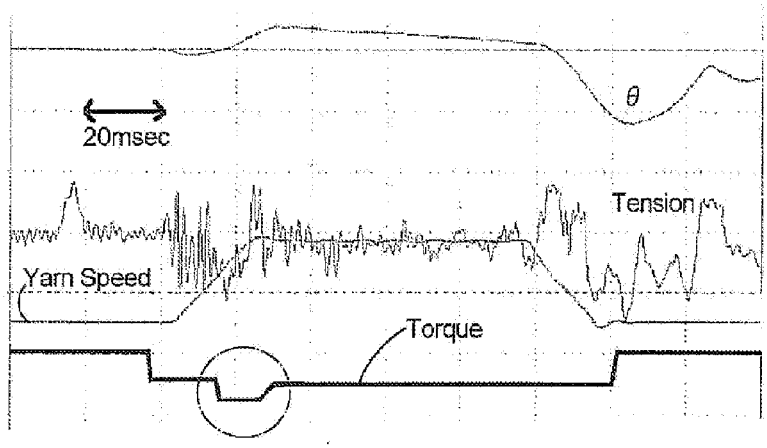
FIG. 7 is a diagram showing a yarn tension T, a yarn speed, the torque of the arm, and a rotation angle θ of the arm according to the embodiment, when the yarn pulling knitting is performed.

FIG. 7 shows a pattern of a target value of the arm torque according to the embodiment. In FIG. 7, the yarn pulling knitting is performed where one vertical scale of the arm torque is equivalent to, for example, 10 gf (approximately 0.0075 N·m) in terms of tension, and one scale of the yarn tension (Tension) is equivalent to, for example, 10 gf (approximately 0.0075 N·m). The maximum value of the yarn speed is 7.7 msec. In addition, the radius of the arm is 7.5 cm. The rotation angle θ of the arm is a negative value on the upper side and the yarn is reeled out of the arm.

In FIG. 7, the torque is reduced immediately before the yarn speed starts increasing. The torque is reduced in accordance with both the yarn speed itself and the rate of increase of the yarn speed. The torque is reduced to a minimum value in a period between a time point before the yarn speed reaches the maximum value and a time point at which the yarn speed reaches the maximum value. In the knitting-middle section, the torque is kept at a substantially constant level. When the knitting is ended, the torque is returned to the original value. Meanwhile, the yarn tension fluctuates in the manner shown in FIG. 7, and the rotation angle θ of the arm slightly becomes a negative value during the knitting. This shows that the arm is pulled toward the carrier and that the yarn is reeled out of the arm.

Figure 9:
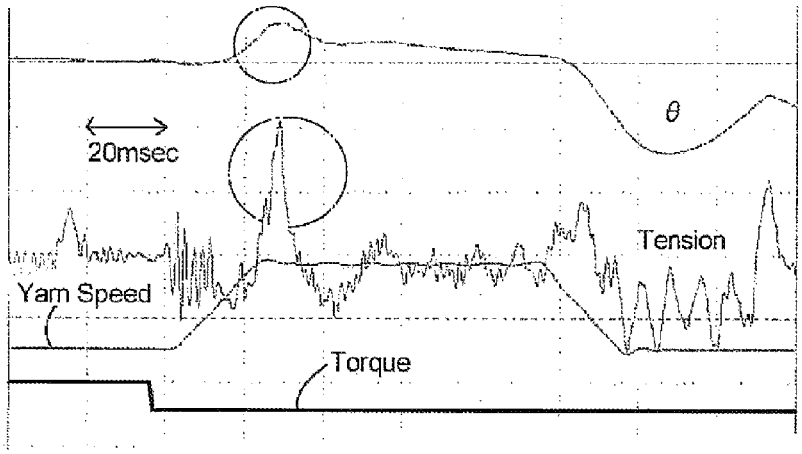
FIG. 9 is a diagram showing a yarn tension T, a yarn speed, a torque of an arm, and a rotation angle θ of the arm according to a prior art where yarn pulling knitting is performed based on the same knitting data used in FIG. 7.

FIG. 9 shows an example in which the torque is kept at the constant value with respect to the same knitting data during the knitting. This example corresponds to a conventional example in which an arm is biased by a constant tension spring. A strong peak is generated in the yarn tension immediately after the yarn speed reaches the maximum value, and accordingly a negative peak is generated in the rotation angle θ. The value of the yarn tension peak is equivalent to 40 gf (approximately 0.4 N), which is likely to cause the yarn to cut if the yarn is weak. Because a half width of the peak is approximately several msec, a torque generator that responds at a speed of 1 msec or lower is required in order to eliminate the tension peak shown in FIG. 9 by performing yarn tension feedback control. Such a torque generator is extremely expensive because it is difficult to rapidly changes a coil current for generating a torque. Moreover, in FIG. 9, because the rotation angle θ changes before the tension peaks, performing the feedback based on the rotation angle θ during the period between the knitting-start section and the initial stage of the knitting-middle section can alleviate the tension peaks more effectively.

Figure 8:
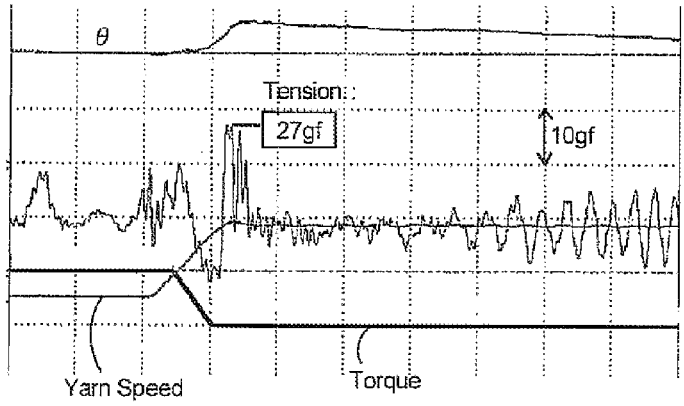
FIG. 8 is a diagram showing the yarn tension T, the yarn speed, the torque of the arm, and the rotation angle θ of the arm according to another embodiment, when the yarn pulling knitting is performed.
Figure 10:
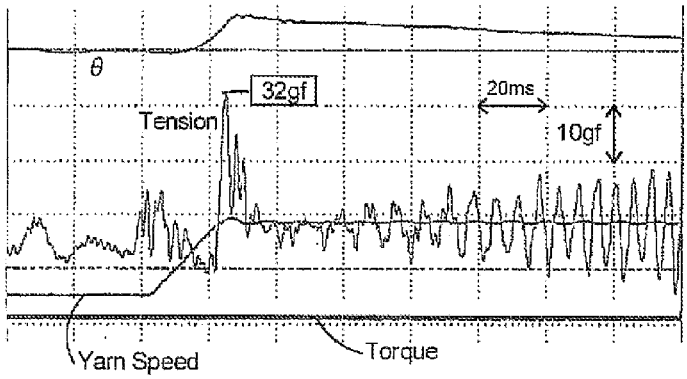
Prior Art FIG. 10
FIG. 10 is a diagram showing the yarn tension T, the yarn speed, the torque of the arm, and the rotation angle θ of the arm according to the prior art where yarn pulling knitting is performed based on the same knitting data used in FIG. 8.

The yarn tensions according to another knitting data in the pull knitting are shown in FIGS. 8 and 10. FIG. 8 corresponds to the embodiment where the arm torque was controlled according to the yarn speed but the correction of the arm torque in response to sharp increase in the yarn speed was not carried out. FIG. 10 corresponds to the conventional example where the arm torque was fixed at $7.5\times10^{-3}$ N·m). One scale of each yarn tension is 10 gf (0.1 N). With the radius of the arm being 7.5 cm, one graduation of the arm torque is 10 gf (0.1 N) in terms of tension. One graduation of time is 20 ms. In the present embodiment, with the tables 50, the maximum value of the yarn tension is reduced to 27 gf (0.27N) by reducing the arm torque when the yarn speed increases. In the conventional example, however, the maximum value of the yarn tension is 32 gf (0.32 N). When the arm torque is reduced to a lower limit of $3.75\times10^{-3}$ N·m during a period when the knitting mode shifts from the last stage of the knitting-start section to the knitting-middle section as in FIG. 7, the peaks of the tension can be further reduced.

The findings of the inventors are described below. Reducing the torque of the arm to the minimum value, when the yarn speed increases above 0 in FIG. 7 (when the operation of the carrier is started), causes the yarn to become loose. In the present embodiment, the tension peaks are generated when the knitting mode shifts from the knitting-start section to the knitting-middle section. The loop length per stitch changes also when the type of stitches is changed, for example, from plain to rib. The change from plain to rib makes the yarn speed increase, and the tension peak may occur. The torque needs to be reduced in this section as well. A decrease in the yarn speed occurs not only at the knitting-end section but also when the knitting structure is changed, for example, from rib to plain which has the shorter loop length. Furthermore, as shown in FIG. 9, the yarn tension fluctuates significantly, when the torque of the buffer arm is constant. In summary, the fluctuations of the yarn tension and cutting of the yarn may be prevented and knitted fabrics with equal stitch size may be knitted, by foreseeing the knitting data to obtain the yarn speed and applying a torque in accordance with the yarn speed and the rate of change of the yarn speed, instead of keeping the torque of the arm at a constant level.

DESCRIPTION OF REFERENCE NUMERALS

2 Flat-knitting machine body
4 Yarn feeding device
6 Carriage
8 Needle bed
10 Carrier rail
12 Carrier
14 Yarn
16 Needle selecting device
18 Cam
20 Traveling motor
22 Knitting data
24 Knitting controller
30 Cone
32 Servomotor
34 Driving roller
36 Driven roller
38 Torque generator
39 Control unit
40 Buffer arm
42 θ sensor
44, 46 Yarn guide
47 Tension sensor
48 Yarn speed calculator
50 Conversion table

What is claimed is:

1. A yarn feeding device for a knitting machine, having a motor for driving a roller from which a yarn is fed out on the basis of knitting data inputted into the knitting machine, and a rotatable buffer for intermediately storing the yarn fed out from the roller and supplying the yarn to the knitting machine, the yarn feeding device further comprising:

a torque generator for applying a variable torque to the buffer;

a yarn speed calculator for obtaining yarn speeds at plural sections in a knitting course from a loop length of a stitch for each knitting needle and a knitting speed calculated base on the knitting data;

conversion means for converting, at the plural sections in the knitting course, the yarn speeds into a plurality of torques to be applied to the buffer so as to correct yarn tension fluctuation caused by the changes in the yarn speeds; and a torque controller controlling the torque generator at the plural sections in the knitting course so that the torque to be applied to the buffer becomes the torque obtained by the conversion unit.

2. The yarn feeding device for a knitting machine according to claim 1, wherein a sensor for detecting a rotation angle of the buffer is provided, and the torque controller corrects the torque obtained by the conversion unit, such that the rotation angle falls within a predetermined range.

3. The yarn feeding device for a knitting machine according to claim 1, wherein the conversion unit has a table for obtaining the torque as a yarn speed function, and correction unit for correcting the torque obtained from the table such that the torque becomes smaller at a section where the yarn speed sharply increases than other sections.

4. The yarn feeding device for a knitting machine according to claim 1, wherein the conversion unit has a plurality of the tables for obtaining the torque as a function of yarn speed in accordance with target yarn tensions.

5. A yarn feeding method for a knitting machine, for making a motor to drive a roller from which a yarn is fed out on the basis of knitting data inputted into a knitting machine, storing the yarn fed out from the roller in a rotatable buffer, and supplying the yarn from the buffer to the knitting machine body, the yarn feeding method further comprising the steps of:

applying variable torques to the buffer by means of a torque generator;

obtaining yarn speeds at plural sections in a knitting course, from a loop length of a stitch for each knitting needle and a knitting speed calculated based on the knitting data;

converting, at the plural sections in the knitting course, the yarn speeds into torques to be applied to the buffer so as to correct yarn tension fluctuation caused by the changes in the yarn speeds; and controlling the torque generator at the sections in the knitting course so that the torque to be applied to the buffer becomes the torque obtained by said converting.

* * * * *